US008455056B1

(12) United States Patent
Browning

(10) Patent No.: US 8,455,056 B1
(45) Date of Patent: Jun. 4, 2013

(54) RAPIDLY-MIXING HIGH VELOCITY FLAME TORCH AND METHOD

(76) Inventor: James A. Browning, Lebanon, NH (US)

( * ) Notice: Subject to any disclaimer, the term of this patent is extended or adjusted under 35 U.S.C. 154(b) by 0 days.

(21) Appl. No.: 13/594,936

(22) Filed: Aug. 27, 2012

Related U.S. Application Data

(60) Provisional application No. 61/677,029, filed on Jul. 30, 2012.

(51) Int. Cl.

| | |
|---|---|
| ***C23C 4/06*** | (2006.01) |
| ***C23C 4/12*** | (2006.01) |
| ***B05D 1/08*** | (2006.01) |
| ***B05D 1/10*** | (2006.01) |

(52) U.S. Cl.
USPC ..... 427/449; 427/446; 427/455; 431/2; 431/12; 239/79; 239/83; 239/84

(58) Field of Classification Search
USPC ..... 239/79, 83, 84; 431/127; 427/449
See application file for complete search history.

(56) References Cited

U.S. PATENT DOCUMENTS

| | | | | |
|---|---|---|---|---|
| 3,030,773 | A * | 4/1962 | Johnson | 60/749 |
| 4,593,856 | A * | 6/1986 | Browning | 239/83 |
| 5,206,059 | A * | 4/1993 | Marantz | 427/449 |
| 5,520,334 | A * | 5/1996 | White | 239/85 |
| 7,628,606 | B1 | 12/2009 | Browning | |

* cited by examiner

*Primary Examiner* — Katherine A Bareford
(74) *Attorney, Agent, or Firm* — Michael J. Weins; Jeffrey E. Semprebon

(57) ABSTRACT

A torch introduces oxidizer into a passage so as to swirl the oxidizer about a central axis, while fuel is introduced at a location spaced apart from the central axis, where the swirling action of the oxidizer is strong, resulting in rapid mixing of the fuel and oxidizer. In practicing the method, the length of a bore through which the fuel and oxidizer pass is maintained short enough that a sheath of unmixed oxidizer surrounds the combusting mixed fuel and oxidizer, eliminating any need for water cooling. The lengths of torches of the present invention can be significantly shorter than those of the prior art, making the torches well suited for use in confined spaces, and the torches have been found to allow spraying materials at a greater rate than torches of the prior art. The reduced length also facilitates introducing into the passage material to be spray-coated.

10 Claims, 6 Drawing Sheets

RAPIDLY-MIXING HIGH VELOCITY FLAME TORCH AND METHOD

FIELD OF THE INVENTION

The present invention provides a high velocity flame torch suitable for uses such as bonding material onto a surface, as well as a related method for producing a supersonic flame jet.

BACKGROUND OF THE INVENTION

U.S. Pat. No. 7,628,606 of the present applicant teaches a high velocity flame torch that does not require water cooling. These torches operate by introducing oxidizer into the torch so as to create a vortex flow of oxidizer, and introducing fuel axially into a low-pressure eye of this vortex. By introducing the fuel into the low pressure eye, a stratified stream of fuel and oxidizer is created where combustion occurs in an expanding central region where the fuel mixes with the oxidizer, while a sheath of unmixed oxidizer surrounds this central region of combustion gases and acts to shield the surrounding structure from excess heating.

SUMMARY OF THE INVENTION

The present invention provides a high velocity flame torch and a method for using the same. The torch has particular utility since it is both compact and does not require water cooling. These features allow it to be used in confined spaces, such as for spraying internal surfaces not readily accessible by the larger torches currently available. The torch of the present invention also has been found to allow a greater throughput of material for depositing coating materials than other torches having similar bore sizes.

The torch of the present invention has a body that terminates at a proximal end and a distal end. The body has a body cylindrical passage extending therethrough, which is symmetrically disposed about a central axis. While the passage is described herein as "cylindrical", it should be appreciated by those skilled in the art that other forms generated by rotating about an axis could be employed, including tapered, frustoconical, stepped, or flared shapes, and combinations thereof. The central passage has a passage first section, which terminates in a torch exit at the distal end, and a passage second section, which terminates in the proximal end. The two passage sections may have similar diameters. Alternatively, the passage first section may include a tapered section to provide smooth gas flow while matching the diameter of the passage first section to that of the passage second section.

An oxidizer port is provided for introducing an oxidizer into the body central passage. The torch has an insert that resides in the passage second section when the torch is in service. A fuel port is also provided, which communicates with at least one fuel passage positioned so as to introduce a gaseous fuel into the passage first section. The one or more fuel passages are further configured to introduce the fuel at one or more locations spaced apart from the central axis.

Means are provided for developing a swirl of the oxidizer in the passage first section. In some embodiments, the oxidizer is introduced from the oxidizer port via an oxidizer supply passage that is substantially normal to the central axis. In such cases, the insert can be configured to form an annular oxidizer chamber in combination with the passage second section. Inclined oxidizer passages through the insert connect the annular oxidizer chamber to the passage first section and, as the oxidizer passes through these inclined oxidizer passages, the inclination serves to impart a swirl to the oxidizer.

Alternatively, a swirling motion can be imparted by introducing the oxidizer into the body central passage via an oxidizer supply passage that is oriented to tangentially intersect a sidewall of the passage first section.

In either case, the introduction of the fuel at a location or locations slightly spaced apart from the central axis results in the fuel being introduced where the swirling action of the oxidizer is significant, causing rapid mixing of the fuel and oxidizer.

In some embodiments, an axial passage is provided through the insert. This axial passage allows a wire to be passed through the axial passage and into the flame resulting from the combusting oxidizer and fuel. If such is done, it has been found that the gap between the wire and the insert axial passage can serve as a toroidal fuel passage, in which case no additional off-axis fuel passage is needed to introduce the fuel. Alternatively, a powder material to be sprayed can be blown into the flame through the axial passage, in which case the fuel should be delivered by one or more off-axis fuel passages. A third possible use of this axial passage is to direct additional oxidizer into the central passage, thereby further accelerating the burning of the fuel without increasing the maximum swirling flow, which might result in difficulty in igniting the mixed fuel and oxidizer if the whirling action is too intense.

In some embodiments, the fuel is introduced into an annular fuel chamber formed by the insert and the passage second section, this annular fuel chamber being fed by a fuel supply passage communicating with the fuel port. In this case, the fuel supply passage is preferably normal to the central axis. Having both the fuel supply passage and the oxidizer supply passage normal to the central axis foreshortens the length of the resulting torch, making it well suited for use in confined spaces.

The structures discussed above are designed to practice a method of establishing a supersonic flame jet. The method of the present invention employs a cylindrical passage having a passage first section, defined by a first section sidewall that is symmetrically disposed about a central axis and terminating in a distal end, and passage second section terminating in a proximal end. An oxidizer is introduced into the passage first section so as to develop a swirling stream of the oxidizer therein. At least one stream of fuel is introduced into the swirling oxidizer, each stream of fuel being spaced apart from the central axis and from the first section sidewall. The mixed fuel and oxidizer are ignited, thereby providing a stream of high velocity combustion products.

In some preferred methods, a powder or wire coating material is introduced into the combustion products, this coating material becoming melted to provide droplets that are sprayed by the exiting flame jet to form a coating on a surface onto which the combustion products are directed. In one method, the powder or wire is fed into the cylindrical passage, and in another method, the powder or wire is fed into the combustion products after they exit the cylindrical passage at the distal end. When the material is introduced into the central passage, it can be introduced through an insert axial passage along the central axis, so as to create an obstruction in the insert axial passage to create an annular fuel passage for introducing the fuel.

In other embodiments where powder is employed to provide deposits on a surface, the pressure of the oxidizer and the fuel can be adjusted so as to provide a supersonic velocity as they exit from the torch and the particles of solid material introduced into the stream of gases are sufficiently heated that they weld to a surface on which they impinge.

DETAILED DESCRIPTION

Figure 1:
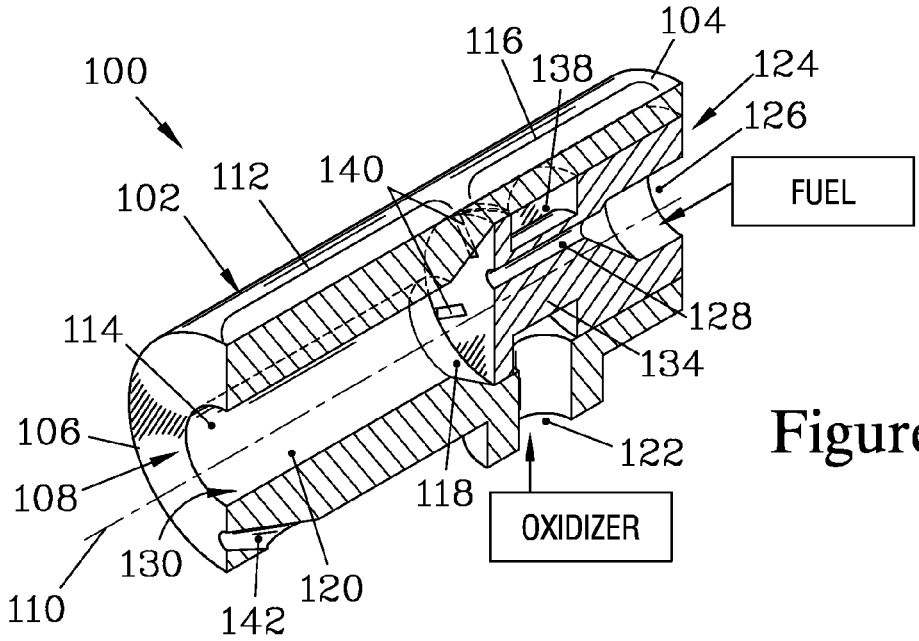
FIG. 1 is an isometric view of a spray torch with two main components, a torch body and a generally cylindrical insert that resides in a body central passage in the body. The insert forms an annular oxidizer chamber and has an array of inclined oxidizer passages that impart a swirl to the oxidizer, as well as a fuel passage that is offset from a central axis of the body central passage. In this embodiment, the body is provided with an angled passage for feeding either a wire or powder material to be sprayed into the path of the flame jet exiting the torch exit.
Figure 2:
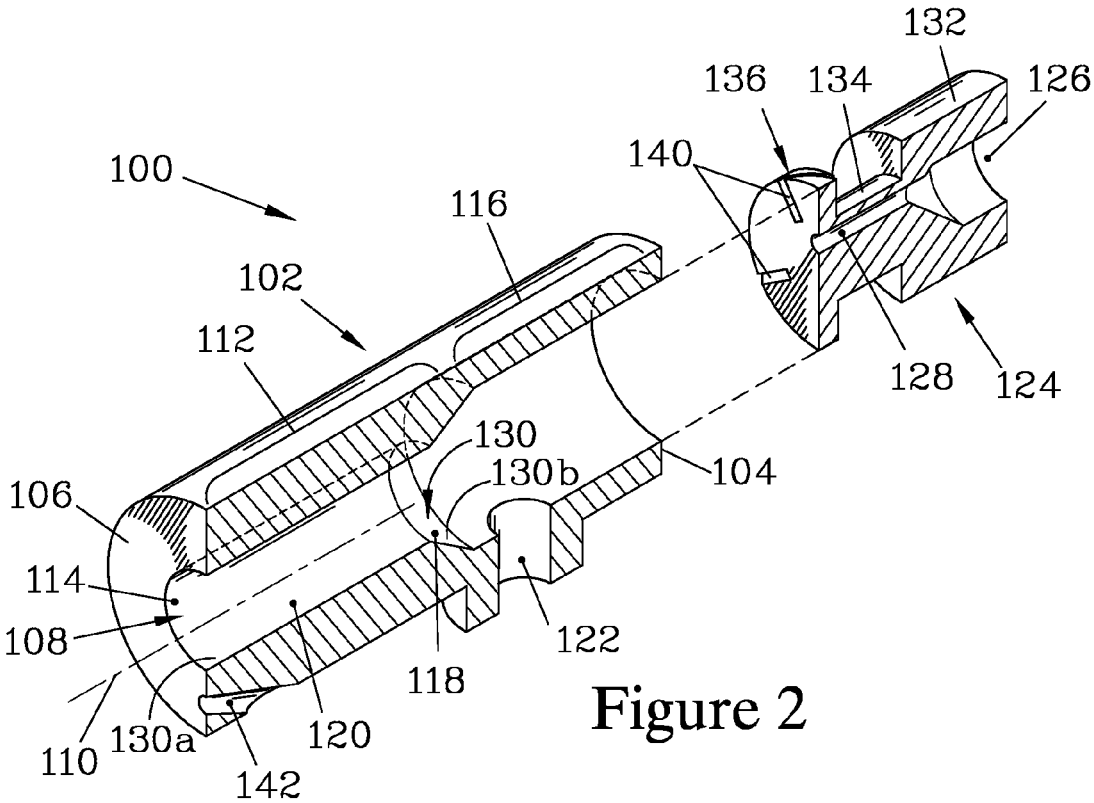
FIG. 2 is an exploded isometric view of the torch shown in FIG. 1, better illustrating the two main components, the body and the insert.

FIGS. 1 and 2 are isometric sectioned views illustrating a rapidly-mixing HVOF high velocity flame torch 100 that forms one embodiment of the present invention. FIG. 1 shows the torch 100 when assembled, while FIG. 2 shows the torch 100 exploded to better illustrate its two basic components. The torch 100 has a body 102 terminating at a proximal end 104 and a distal end 106.

A generally cylindrical body central passage 108 extends through the body 102 along a central axis 110, about which the body central passage 108 is symmetrical. The body central passage 108 has a passage first section 112 that terminates in a torch exit 114 at the distal end 106 of the body 102, and a passage second section 116 that terminates at the proximal end 104 of the body 102. In the torch 100, the passage first section 112 includes a tapered section 118 and a cylindrical bore section 120, where the tapered section 118 joins between the cylindrical bore section 120 and the passage second section 116, which is larger in diameter than the cylindrical bore section 120.

An oxidizer port 122 is provided, which can be connected to a conventional oxidizer supply line (not shown) and which communicates with the body central passage 108 to introduce the oxidizer thereinto. For simplicity of structure, the oxidizer port 122 is provided in the body 102 to provide access to the body central passage 108. In the torch 100, the oxidizer is introduced directly from the oxidizer port 122 into the passage second section 116, as discussed in greater detail below.

The other basic component of the torch 100 is an insert 124 that resides in the passage second section 116 of the body 102. For purposes of discussion, the passage second section 116 is defined as the portion of the body central passage 108 in which the insert 124 resides; the enlarged diameter of the passage second section 116 relative to the cylindrical bore section 120 eases accommodation of the insert 124. The insert 124 has a fuel port 126 for connection to a conventional source of fuel gas (not shown), the fuel port 126 being positioned on the central axis 110 when the insert 124 is installed in the passage second section 116, as shown in FIG. 1. The fuel port 126 communicates with a fuel passage 128 that extends through the insert 124 so as to terminate at the passage first section 112 of the body central passage 108. The fuel passage 128 is spaced apart from the central axis 110 as well as from a passage first section sidewall 130. In this embodiment, the passage first section sidewall 130 has a sidewall cylindrical section 130*a* (labeled in FIG. 2) as well as a sidewall truncated conical section 130*b* which is preferably included to smooth the flow of gases. While shown extending parallel to the central axis 110, the fuel passage 128 could be slightly angled with respect thereto.

The insert 124 is formed with an insert first section 132, in which the fuel port 126 is provided, an insert second section 134, and an insert third section 136, as labeled in FIG. 2. The insert first section 132 and the insert third section 136 are sized to slidably engage the passage second section 116, while the insert second section 134 has a reduced cross section to form, in combination with the passage second section 116, an annular oxidizer chamber 138 (shown in FIG. 1). The annular oxidizer chamber 138 communicates with the oxidizer port 122 to receive oxidizer therefrom.

To provide means for developing a swirl of the oxidizer as it passes into the passage first section 112, angled oxidizer passages 140 are provided through the insert third section 136 so as to communicate between the annular oxidizer chamber 138 and the passage first section 112. The angled oxidizer passages 140 are inclined to the central axis 110 so as to introduce the oxidizer into the passage first section 112 with a substantial rotational component of motion, thereby swirling the oxidizer to create a vortex flow in the passage first section 112, this swirling flow having a low pressure eye extending along the central axis 110. The inclination of the angled oxidizer passages 140 can be varied to adjust the swirling action of the oxidizer. In prototype torches, it has been found effective for the angled oxidizer passages 140 to be inclined with respect to the central axis 110 by about 70°.

As noted above, the fuel passage 128 is spaced apart from the central axis 110 and from the passage first section sidewall 130. This positions the fuel passage 128 to introduce the fuel in the vicinity of the location where the swirling action of the oxidizer is greatest, since the velocity in the oxidizer vortex increases as it approaches an eyewall region that surrounds the low pressure eye, where there is minimal swirling action. The introduction of the fuel into a region where the swirling action of the oxidizer is very strong increases the rate of mixing of the fuel and oxidizer for combustion, while retaining a sheath of unmixed oxidizer surrounding the combustion gases after the mixed fuel and oxidizer are ignited. The increased speed of mixing of the fuel into the oxidizer provided by this positioning of the fuel passage 128 has been found to generate a high-velocity flame jet in a relatively short bore length. In fact, it has been found that the bore length can be reduced to less than half the length employed by torches taught in the '606 patent, where the fuel is introduced axially into the low-pressure eye of the swirling oxidizer. This allows the torch 100 to be made very compact in size, suitable for use in extremely confined spaces. The bore length (length of the passage first section 112) is maintained such that an unmixed sheath of the oxygen surrounds the combustion gases throughout the length of the passage first section 112 to buffer the body 102 from the heat generated by the combustion. It should be noted that the formation of the low pressure eye allows the combined fuel and oxidizer to be ignited after exiting the torch exit 114, in which case the flame rapidly progresses upstream to form a combustion region within the passage first section 112. Alternatively, the combined fuel and oxidizer could be ignited within the passage first section 112, such as by a spark plug.

When the torch 100 is to be employed for thermal spraying applications, the body 102 can be provided with a coating stock passage 142 that terminates at the distal end 106. The coating stock passage 142 allows feeding either a wire or powder coating material to be sprayed, and directs the coating material into the path of the flame jet resulting from combustion and exiting the torch exit 114.

Figure 3:
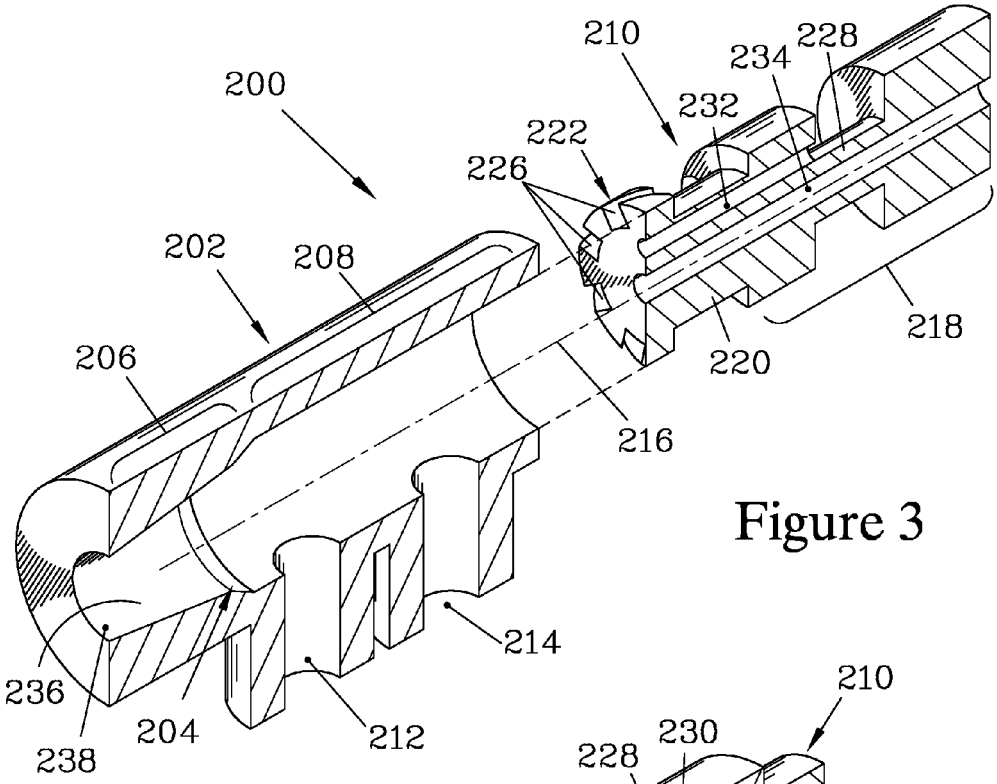
FIG. 3 is an exploded isometric section view of a spray torch that forms a second embodiment of the present invention, which again has two main components. The torch again has a body having a body central passage, and an insert that forms an annular oxidizer chamber into which the oxidizer is introduced. However, in this embodiment the insert also forms an annular fuel chamber into which fuel is introduced, from which the fuel passes through an off-axis fuel passage to the passage first section. Both annular chambers surround an insert axial passage through which additional oxidizer and/or a material to be sprayed can be introduced.
Figure 4:
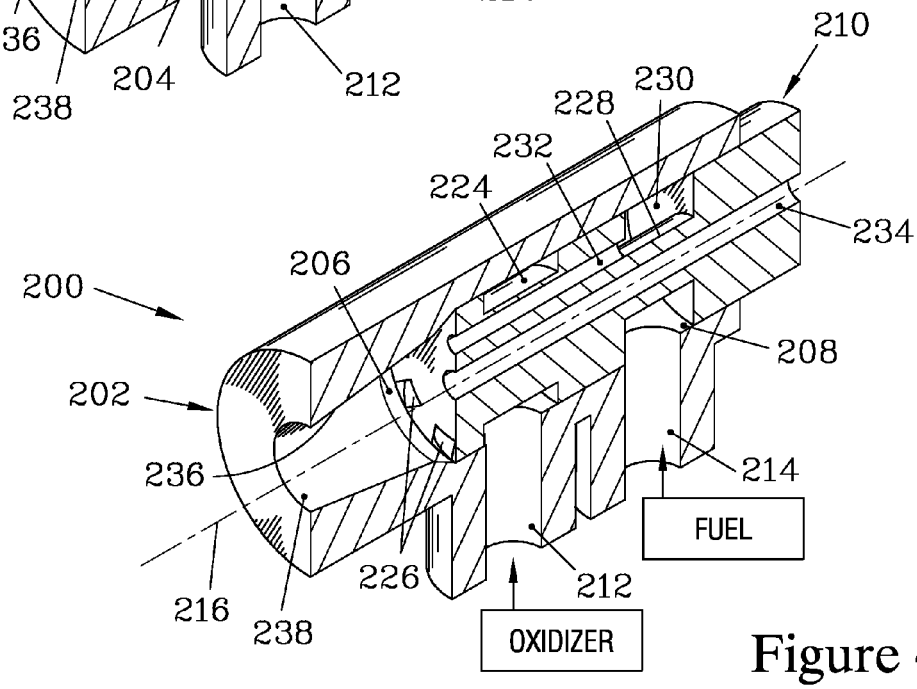
FIG. 4 is a view of the sections illustrated in FIG. 3 when the torch is assembled.

FIGS. 3 and 4 are isometric section views of a high velocity flame jet torch 200 that forms a second embodiment of the present invention; FIG. 3 shows the torch 200 exploded to illustrate the two main components, while FIG. 4 shows the torch 200 assembled. The torch 200 again has a body 202 having a generally cylindrical body central passage 204 having a passage first section 206 and a passage second section 208, and has an insert 210 that resides in the passage second section 208. In the torch 200, the body 202 not only has an oxidizer port 212, but also a fuel port 214 which is positioned normal to a central axis 216 about which the body central passage 204 is disposed. This provides for foreshortening the overall length of the torch 200, making it well suited for use in confined spaces.

The insert 210 of the torch 200 is again formed with an insert first section 218, an insert second section 220, and an insert third section 222 (these sections being labeled in FIG. 3), and again the insert second section 220 forms an annular oxidizer chamber 224 when the insert 210 is housed in the passage second section 208 as shown in FIG. 4. The oxidizer is introduced into the oxidizer chamber 224 via the oxidizer port 212. Angled oxidizer passages 226 through the insert third section 222 impart a swirling action to the oxidizer as it passes into the passage first section 206.

The insert first section 218 of this embodiment is formed with a first section reduced section 228, which forms an annular fuel chamber 230 within the passage second section 208 (shown in FIG. 4). The annular fuel chamber 230 communicates with the fuel port 214, and also with a fuel passage 232 which extends parallel to and spaced apart from the central axis 216. The fuel passage 232 extends through a portion of the insert first section 218 and completely through the insert second and third sections (220, 222) so as to communicate between the annular fuel chamber 230 and the passage first section 206. Being spaced apart from the central axis 216 results in the fuel being introduced at a location offset from an axial low pressure eye of the swirling oxidizer, and thus the fuel is introduced at a location where there is significant swirling action to cause rapid mixing of the fuel and oxidizer.

The insert 210 also has an insert axial passage 234 extending completely therethrough. When the insert 210 is engaged with the body 202, the insert axial passage 234 resides along the central axis 216. When a material is to be thermally sprayed by the torch 200 from a source, such as a metal wire or rod, or a powdered material blown by compressed gas (which could be a relatively inert gas or fuel), this material can be introduced through the insert axial passage 234. Even when a fuel gas is employed to propel the powder material, fuel is also supplied through the off-axis fuel passage 232. In prior art torches, introduction of a coating material to be sprayed into the central passage of a torch has created a risk of catastrophic failure if the material accumulates and clogs the bore of the torch. However, the rapid mixing of the fuel and oxidizer provided by the torches of the present invention makes the introduction of material into the body central passage practical, since the resulting short bore length reduces the risk of failure due to material accumulating within the body central passage.

In this embodiment, the configuration of the passage first section 206 has a sidewall 236 with a slight taper reducing the diameter of the passage first section 206 as it approaches a torch exit 238, making the passage first section 206 generally frustoconical in form. This reduction in diameter as the torch exit 238 is approached is felt to be beneficial when wire coating material is introduced via the insert axial passage 234. The sidewall 236 has a steeper decent as it approaches and joins with the passage second section 208 so as to maximize the effective depths of the angled oxidizer passages 226 that can be employed and to provide a nozzle to help focus the vortex of oxidizer.

An alternative use for the insert axial passage 234 is to employ it to inject additional oxidizer into the passage first section 206. Such additional oxidizer could increase the rate of combustion of the fuel and the oxidizer while maintaining a limit on the swirling action of the oxidizer so as to avoid any need to employ a swirl that would be so strong as to make ignition of the mixed fuel and oxidizer difficult.

Figure 5:
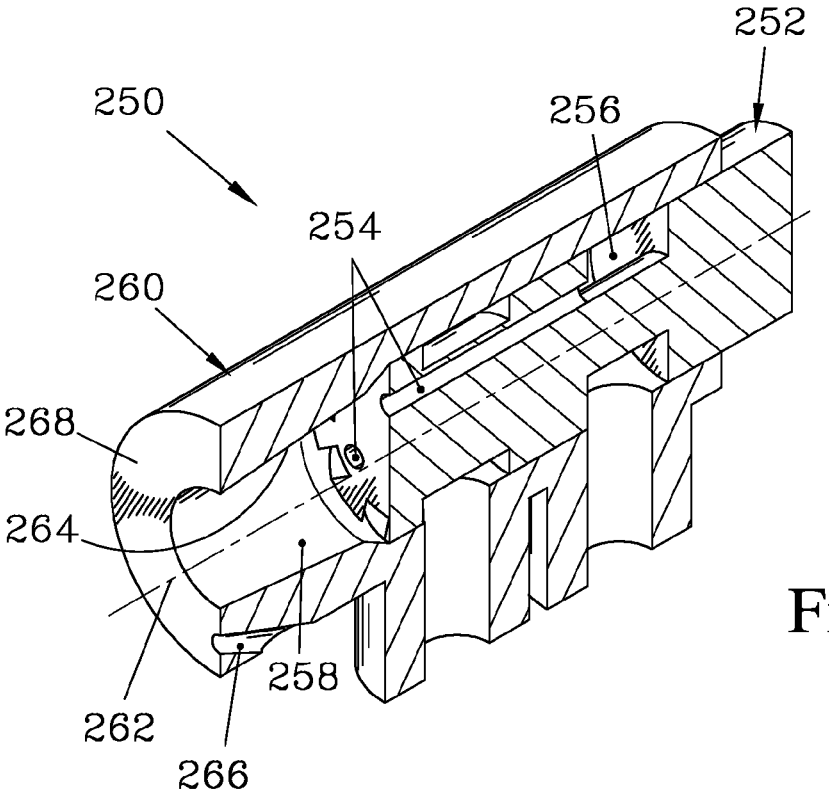
FIG. 5 is an isometric section view of a torch that is similar to that shown in FIGS. 3 and 4; however, there is no insert axial passage. This torch also has an insert having an array of three fuel passages for introducing the fuel. These fuel passages are symmetrically disposed about the central axis of the body central passage and extend parallel thereto.

FIG. 5 is an isometric section view of a torch 250 that has many features in common with the torch 200 shown in FIGS. 3 and 4, but where an insert 252 is provided with an array of three fuel passages 254 that communicate between an annular fuel passage 256 and a passage first section 258 of a body 260. The fuel passages 254 are spaced apart from a central axis 262 and from a passage first section sidewall 264. The use of multiple fuel passages 254 rather than a single passage is frequently preferred for larger sizes of torches to provide more even distribution of the fuel, while the use of a single passage, such as shown in FIGS. 1-4, may be preferred for smaller torches to ease fabrication. An alternative approach to introducing the fuel at a location spaced apart from the central axis in an evenly distributed manner is to employ an annular fuel passage, as discussed below in the description of FIGS. 9 through 12.

The torch 250 also differs from the torch 200 shown in FIGS. 3 and 4 in that it lacks any axial passage through the insert. The body 260 of the torch 250 is provided with a coating stock passage 266 that terminates at a distal end 268 of the body 260. This coating stock passage 266 is provided for introduction of powder or wire into the exiting stream of combustion gases.

Figure 6:
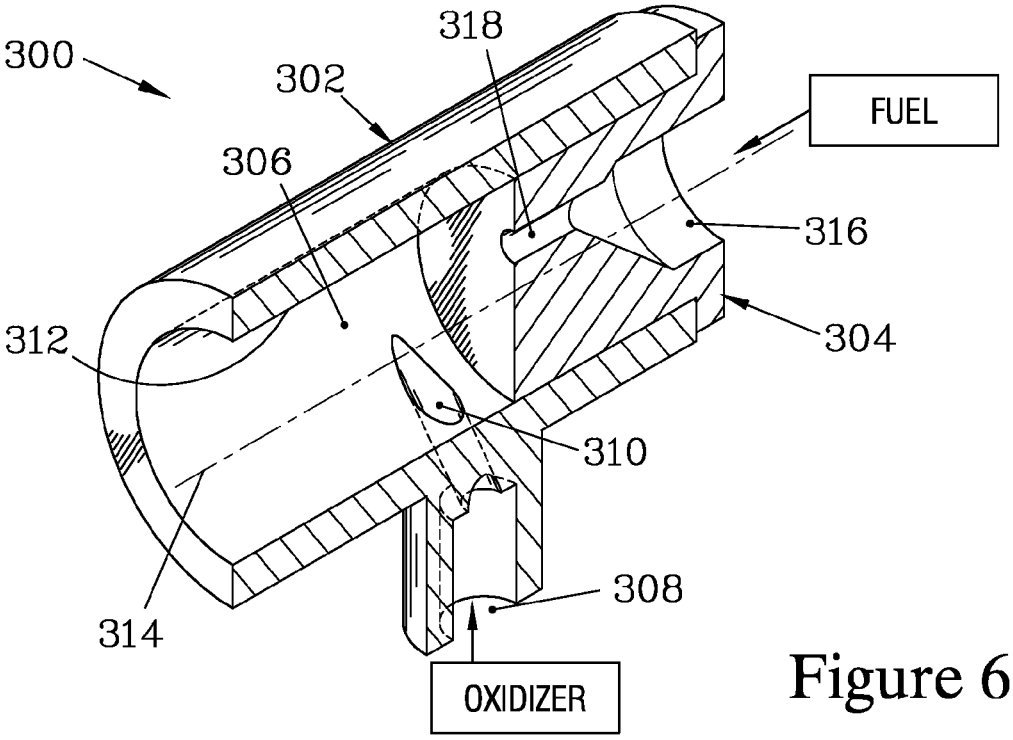
FIG. 6 is an isometric section view of a torch that forms another embodiment of the present invention, again formed by a body and a cylindrical insert residing therein. This torch differs from the earlier illustrated torches in the structure that is employed for forming a vortex flow of the oxidizer. In this embodiment, the oxidizer is introduced into a passage first section via a skewed oxidizer passage that intersects a sidewall of the passage first section in a tangential manner that causes the oxidizer to swirl within the passage first section. In this embodiment, a single fuel supply passage extends through the insert to communicate with a fuel port that resides on the central axis of the body in which the insert resides.

FIG. 6 is a sectioned isometric section view of a torch 300 that forms another embodiment of the present invention, again having a body 302 and an insert 304 that resides at least partially within the body 302. The torch 300 differs from the torches discussed above in the means for forming a swirling flow of the oxidizer as it is introduced into a passage first section 306 from an oxidizer port 308. In this embodiment, the oxidizer is introduced into the passage first section 306 via a tangential oxidizer passage 310 that intersects a passage first section sidewall 312 in a tangential manner. The tangential oxidizer passage 310 introduces the oxidizer off-center with respect to a central axis 314, which causes the oxidizer to swirl within the passage first section 310 about the central axis 314.

The insert 304 is provided with a fuel port 316 communicating with a fuel passage 318. The fuel port 316 is positioned on the central axis 314, while the fuel passage 318 extends parallel to and spaced apart from the central axis 314, so as to introduce the fuel into the swirling oxidizer in the passage first section 306 at a location spaced apart from both the central axis 314 and the passage first section sidewall 312.

Figure 7:
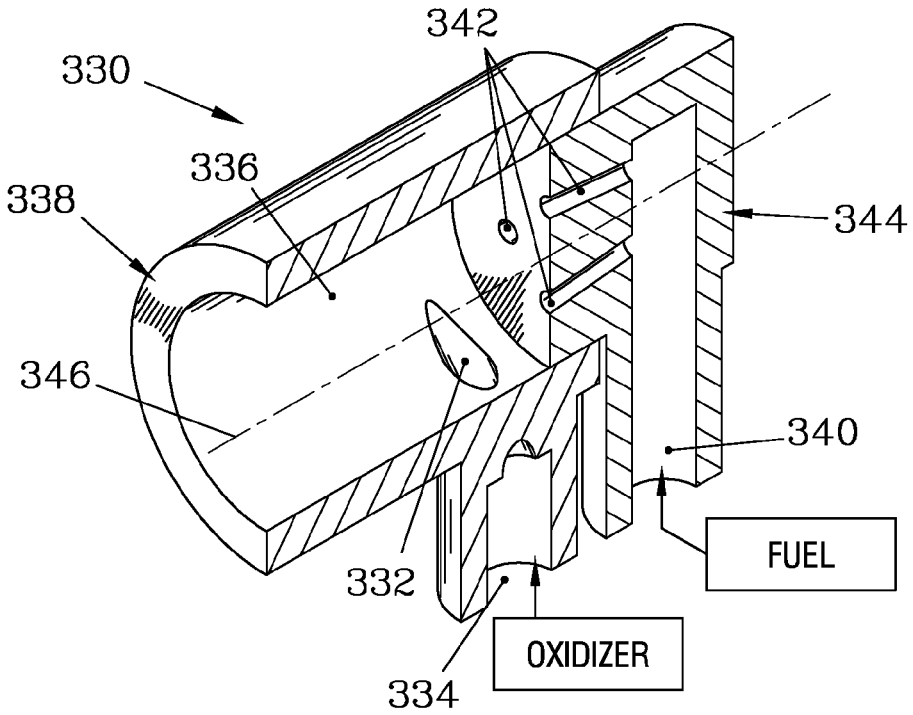
FIG. 7 is a sectioned isometric view of a torch similar to that shown in FIG. 6, but where the fuel is introduced via an array of fuel supply passages from a fuel port that extends normal to the central axis. This configuration reduces the overall length of the torch, making this embodiment well suited to use inside confined spaces.

FIG. 7 is a sectioned isometric view of a torch 330 that forms another embodiment of the present invention that employs a tangential oxidizer passage 332 to impart a swirl into oxidizer supplied from an oxidizer port 334 as the oxidizer is introduced into a passage first section 336 of a torch body 338. In the torch 330, the fuel is introduced from a fuel port 340 via an array of fuel passages 342 through an insert 344, where the fuel passages 342 are disposed about a central axis 346. The use of multiple fuel passages 342 serves to more evenly distribute the fuel compared to a single passage as employed in the torch 300 discussed above. In this embodiment, the fuel passages 342 are slightly inclined with respect to the central axis 346.

The torch 330 also differs in that the fuel port 340 extends normal to the central axis 346 in order to minimize the overall length of the torch 330.

Figure 8:
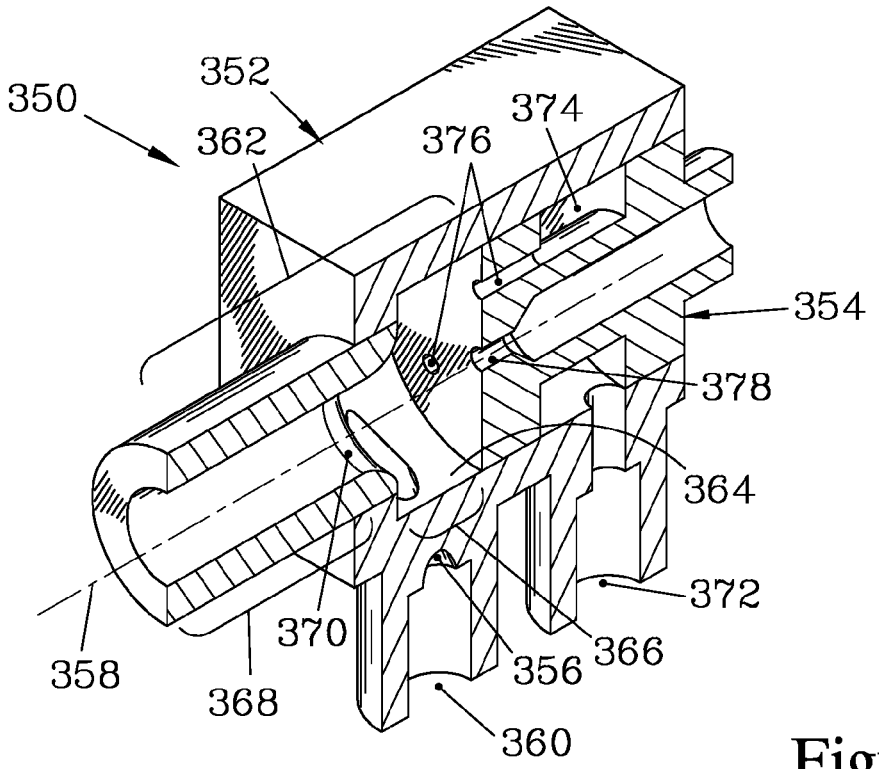
FIG. 8 is a sectioned isometric view of a torch that forms another embodiment that employs a tangentially-directed passage to swirl the oxidizer as it is introduced into a passage first section. The passage first section of this embodiment is stepped, having regions with two different diameters that are joined by a curved transition region to provide the effect of a nozzle for intensifying the oxidizer vortex as it passes along the passage first section. The fuel is introduced into an annular fuel chamber and thereafter passes through three parallel fuel passages so as to be introduced into the swirling oxidizer flow at locations offset from the central axis, in the vicinity of the location where the swirling action is strongest. An insert axial passage is also provided through the insert, extending along its central axis for introduction of additional oxidizer and/or a material to be sprayed.

FIG. 8 is an isometric section view of a torch 350 that forms another embodiment of the present invention. The torch 350 has a body 352 and an insert 354 residing therein. The torch 350 again employs an oxidizer passage 356 that is skewed with respect to a central axis 358 to introduce oxidizer from an oxidizer port 360 to a passage first section 362 in the body 352. The oxidizer passage 356 intersects a passage first section sidewall 364 in a tangential manner, such that the oxidizer is introduced into the passage first section 362 off center, causing the oxidizer to swirl within the passage first section 362.

In the body 352, the passage first section 362 is stepped, having cylindrical regions (366, 368) with two different diameters that are joined by a curved transition region 370. This configuration provides the effect of a nozzle for intensifying the oxidizer vortex as it passes along the passage first section 362.

Fuel in this embodiment is introduced from a fuel port 372 into an annular fuel chamber 374, similar to those employed in the torches shown in FIGS. 3-5. From the annular fuel chamber 374, the fuel is introduced into the swirling oxidizer flow via three parallel fuel passages 376 (only two of which are visible). Again, the fuel passages 376 are positioned to release the fuel into the passage first section 362 at locations offset from the central axis 358 and from the passage first section sidewall 364, in the vicinity of the location where the swirling action of the oxidizer should be strongest.

The insert 354 has an insert axial passage 378 that extends along the central axis 358, and can serve for introduction of additional oxidizer and/or a material to be sprayed.

While the embodiments discussed above employ one or more discrete fuel passages to introduce the fuel at a location spaced apart from the central axis, it has been found possible to employ a continuous annular fuel passage that is centered on the central axis. The center of this annular fuel passage could be formed by a fixed obstruction; however, as discussed below, this obstruction can be advantageously provided by a wire of material to be sprayed.

Figure 9:
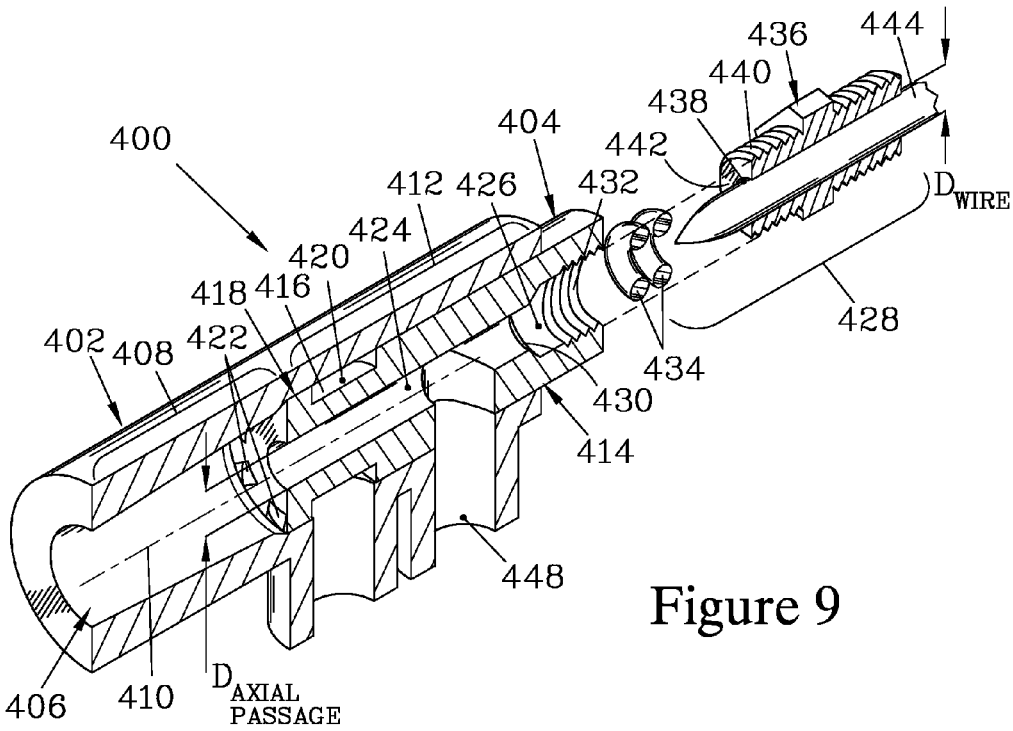
FIGS. 9 and 10 are sectioned isometric views that illustrate a torch that forms another embodiment of the present invention, with FIG. 9 showing the torch partially exploded and FIG. 10 showing the torch when assembled. Rather than employing an array of discrete fuel passages distributed about the central axis, this torch employs a continuous annular fuel passage surrounding the central axis. The annular fuel passage is formed by an insert axial passage through the insert that is obstructed along the central axis by a wire of a material to be introduced into the flame jet so as to be sprayed, the wire being undersized relative to the insert axial passage to create an annular space. The axial insert passage communicates with a fuel port and is sealed by a seal assembly that allows the wire to be slidably advanced therethrough.
Figure 10:
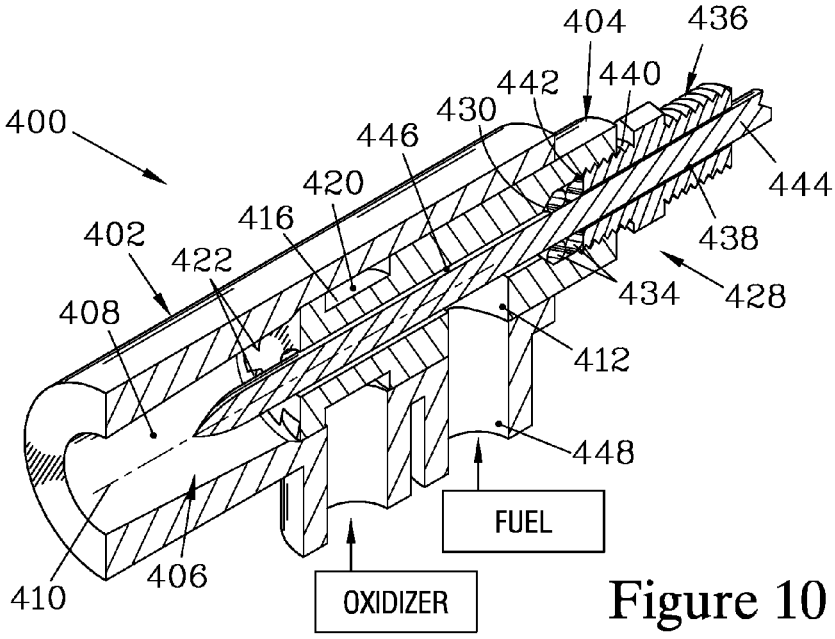

FIGS. 9 and 10 illustrate a torch 400 having a body 402 and an insert 404. The body 402 has a body central passage 406 having a passage first section 408 that is symmetrically disposed about a central axis 410, and a passage second section 412 in which the insert 404 resides. The insert 404 is formed with an insert first section 414, an insert second section 416, and an insert third section 418, where the insert second section 416 has a reduced diameter that forms an annular oxidizer chamber 420 within the passage second section 412. Oxidizer is introduced from the annular oxidizer chamber 420 into the passage first section 408 through an array of angled oxidizer passages 422 through the insert third section 418.

The insert 404 is also provided with an insert axial passage 424 (shown in FIG. 9) extending therethrough, which is a cylindrical passage centered on the central axis 410 when the insert 404 is installed in the passage second section 412. The insert axial passage 424 terminates at one end at the passage first section 408, and at the other end in an insert threaded recess 426 in the insert first section 414. The insert threaded recess 426 is configured to accept a gas seal assembly 428. The insert threaded recess 426 has a sloped wall 430 surrounding the insert axial passage 424, and a female threaded section 432.

The seal assembly 428 has one or more resilient rings 434, which are illustrated as O-rings, and a wire guide element 436 having a guide passage 438 therethrough and a male threaded section 440 that terminates in a guide bearing surface 442. The guide passage 438 is sized to accept a wire 444 of a material to be sprayed by the torch.

The seal assembly 428 can be installed into the insert 404 by first slipping the resilient rings 434 over the wire 444, and then inserting the resilient rings 434 into the insert threaded recess 426, and subsequently threadably engaging the male threaded section 440 of the wire guide element 436 with the female threaded section 432 of the insert threaded recess 426. Threadably advancing the wire guide element 436 causes the resilient rings 434 to become compressed between the guide bearing surface 442 and the sloped wall 430, as shown in FIG. 10. The sloped wall 430 acts to forcibly engage the resilient rings 434 against the wire 444 to create a gas-tight seal. Threadable adjustment allows a user to adjust the degree of compression to provide a seal while still allowing the wire 444 to be slidably advanced along the central axis 410. The guide passage 438 and the resilient rings 434 serve to position the wire 444 such that it resides on the central axis 410. The insert axial passage 424 is oversized with respect to the wire 444, having a passage diameter $D_{AXIAL\ PASSAGE}$ that is greater than a wire diameter $D_{WIRE}$ of the wire 444, resulting in an annular passage 446 (shown in FIG. 10) remaining when the wire 444 passes through the insert axial passage 424, this annular passage 446 being disposed about the central axis 410.

A fuel port 448 communicates with the annular passage 446, allowing the annular passage 446 to serve as a fuel passage which introduces the fuel into the passage first section 408 in an annular space that surrounds the central axis 410 and is spaced apart therefrom. The fuel port 448 can be conveniently provided by machining after the insert 404 has been installed into the passage second section 412.

While the torch 400 employs the wire that forms the annular fuel passage as material to be sprayed, it should be appreciated that a similar structure employing a cylindrical element positioned on the central axis could be employed to provide an annular fuel passage where the cylindrical element is not sprayed.

Figure 11:
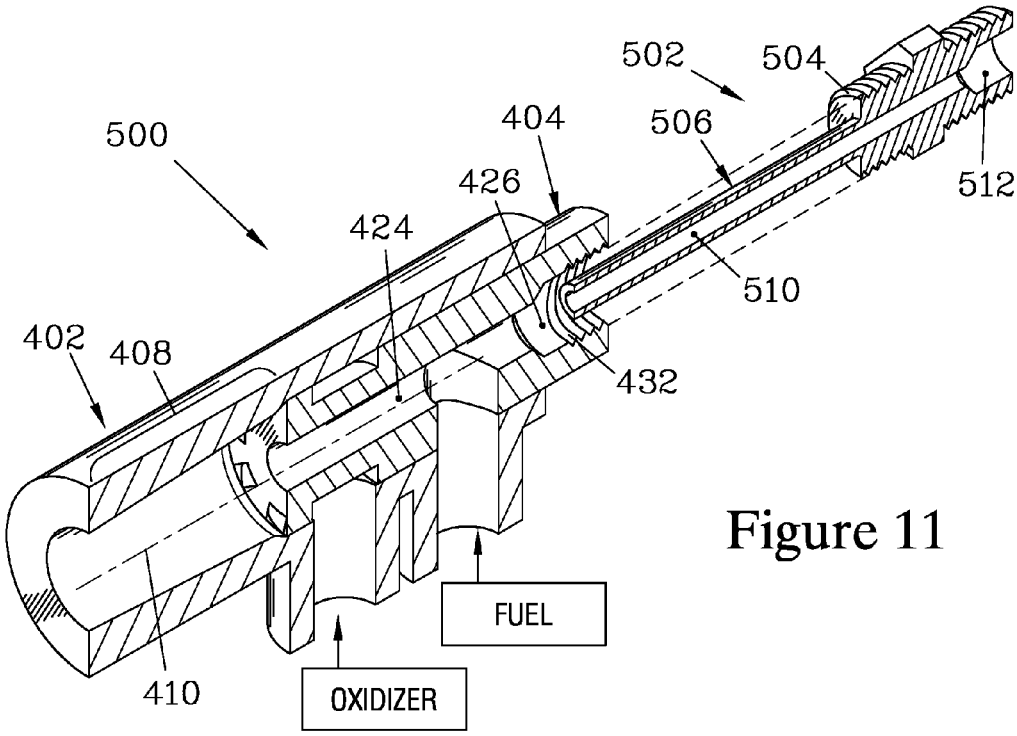
FIGS. 11 and 12 are sectioned views of a torch that incorporates the same body and insert as employed in the torch shown in FIGS. 9 and 10, but where the torch is employed to spray a powdered coating material rather than a wire. The torch has a powder injector assembly that attaches to the insert and has a powder conduit that extends through the insert axial passage. The powder conduit is undersized relative to the insert axial passage so as to form an annular fuel passage.
Figure 12:
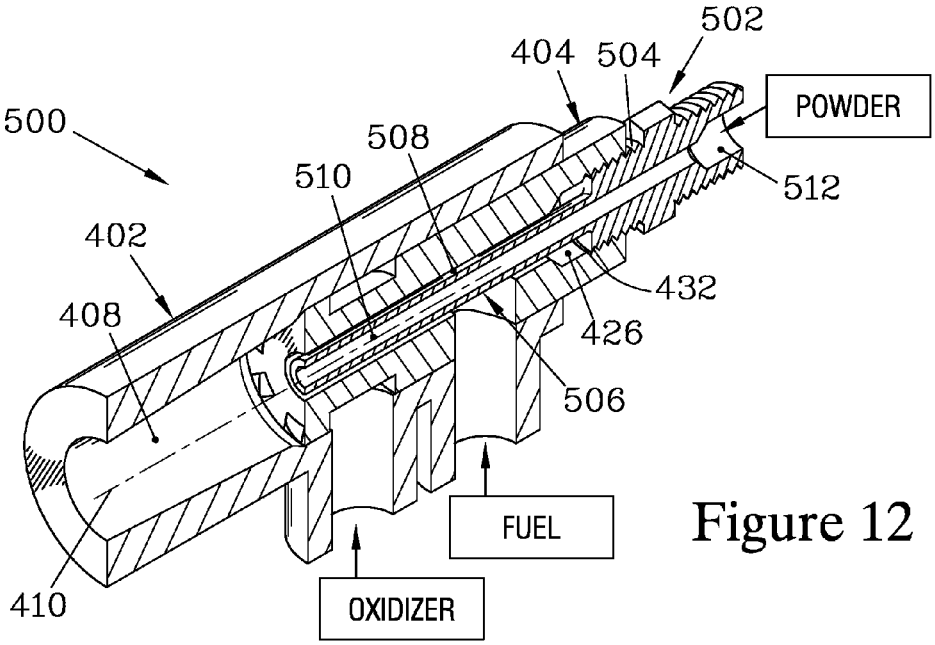

FIGS. 11 and 12 illustrate a torch 500 that employs the body 402 and the insert 404 employed in the torch 400, but where the seal assembly 428 (shown in FIGS. 9 and 10) is replaced with a powder injector assembly 502. The powder injector assembly 502 has a male threaded portion 504, which is configured to engage the female threaded section 432 of the insert threaded recess 426, and a powder conduit 506 that extends forward from the male threaded section 504. When the male threaded section 504 is engaged with the female threaded section 432, the powder conduit 506 is centered on the central axis 410 and extends through the insert axial passage 424 (labeled in FIG. 11) so as to form an annular fuel passage 508 (shown in FIG. 12). The powder conduit 506 has a powder injection passage 510 therethrough extending from the passage first section 408 to a powder port 512 that can be connected to a conventional feed (not shown) for supplying a powdered coating material driven by compressed gas.

EXAMPLES

A torch having the structure shown in FIGS. 1 and 2, but having three fuel passages for introducing the fuel, was constructed having a passage first section of ⅜" diameter along its length terminating at tie torch exit. The fuel was introduced through three passages of 0.06" diameter, each offset ⅛" from the central axis. Employing gaseous oxygen as the oxidizer and propane as the fuel, this torch was found to have a maximum uncooled length of the passage first section significantly shorter than a torch of similar configuration, but introducing the fuel along the central axis as taught in U.S. Pat. No. 7,628,606. The maximum uncooled length can be readily determined experimentally, as taught in the '606 patent, which is incorporated herein by reference. According to this method for determining length, the torch is operated with a body blank having an initial length which is substantially longer than the final length. When the combined fuel and oxidizer is ignited and burns, the combustion gases expand as they progress down the passage first section. At some point, the combustion gases expand so as to be close enough to the passage sidewall that the sheath of unmixed cool oxidizer is no longer sufficient to prevent substantial heating of the body, and the heat from the combustion gases causes a terminal portion of the body blank to melt, leaving a base portion remaining. The length of the remaining base portion defines the maximum practical length of the passage first section (bore length) for the particular operating conditions employed. The length of the passage first section is then selected to be somewhat shorter than this maximum practical length. It was found that, while a torch of the '606 patent had a bore length of 4", the torch of the present invention described above had a bore length of 1¾, and this length could be reduced to 1½ while retaining desirable performance. For comparison of performance, these torches were employed to spray ⅛" diameter stainless steel rod that was fed into the exiting flame, operating with an oxygen pressure of 300 psi and a propane fuel pressure of 150 psi. A standard welding wire feeder was employed to supply the ⅛" stainless steel rod. In this comparative testing, it was found that the maximum spray rate increased from about 40 lbs/hour for the torch of the '606 patent to about 50 lbs/hour for the torch of the present invention, with the stainless steel coating deposited on the woKpiece appearing similar in both cases.

A torch of similar size, but using the configuration of the torch shown in FIGS. 9 and 10 was found to provide an even greater rate of spray. Propylene was employed as the fuel, delivered through an annular passage formed by passing the ⅛" diameter wire through an insert axial passage that was 5/32" diameter. This torch was able to spray the wire coating material at a rate of 64 lbs./hour.

Further testing of torches employing an array of discrete fuel passages suggests that the degree of mixing can be adjusted by increasing or decreasing the offset of the fuel passages from the central axis. Increasing the distance was found to require a shortened length of the bore to avoid melting, defining a maximum length as discussed in the '606 patent. Decreasing the distance to position the fuel passages closer to the central axis was found to allow a longer length.

While the novel features of the present invention have been described in terms of particular embodiments and preferred applications, it should be appreciated by one skilled in the art that substitution of materials and modification of details can be made without departing from the spirit of the invention.

What I claim is:

1. A method of establishing a supersonic flame jet from a torch used for bonding material onto a surface, comprising the steps of:

providing the torch with an elongated passage having a passage first section bounded by a passage sidewall that is substantially symmetrical about a central axis and a passage second section, the passage extending between a distal end and a proximal end;

introducing a flow of oxygen into the passage first section with a rotational component of motion about the central axis so as to develop a swirling stream of the oxygen in the passage first section where the oxygen swirls about the central axis, this swirling oxygen being constrained against the passage sidewall;

introducing at least one stream of gaseous fuel into the swirling oxygen, each of the at least one streams of fuel being offset from the central axis and from the passage sidewall so as to introduce the gaseous fuel into the oxygen within the passage first section in the vicinity of the location where the swirling action of the oxygen is greatest so as to mix the fuel and oxygen;

limiting the length of the passage first section such that the swirling stream of the oxygen provides a sheath of unmixed oxygen along the passage sidewall extending at least through the passage distal end; and igniting the mixed fuel and oxygen so as to cause combustion as well as mixing of the fuel and oxygen within the passage first section, thereby providing a supersonic stream of combustion products exiting from the passage distal end.

2. The method of claim 1 wherein the stream of combustion products is employed to coat a solid coating material onto a workpiece onto which the combustion products impinge, the method further comprising the step of:

introducing the solid coating material into the passage from the proximal end.

3. The method of claim 1 wherein the stream of combustion products is employed to deposit a solid coating material onto a workpiece onto which the combustion products impinge, the method further comprising the step of:

introducing the solid coating material into the combustion products after they exit the passage at the distal end.

4. The method of claim 1 wherein said step of introducing at least one stream of fuel into the swirling oxidizer further comprises the steps of:

providing an axial passage extending along the central axis to the proximal end;

obstructing a portion of the axial passage with an axial obstruction that resides on the central axis so as to form an annular fuel passage between the axial obstruction and the axial passage where the annular fuel passage is disposed about the central axis; and introducing the fuel into the annular fuel passage so as to produce the at least one stream of fuel.

5. The method of claim 4 wherein said step of obstructing a portion of the axial passage further comprises:

inserting a wire through the axial passage to provide the axial obstruction; and creating a gas-tight seal between the wire and the axial passage in the proximal end to seal the annular fuel passage with respect to the wire.

6. The method of claim 5 wherein the wire is formed of a metal material to be sprayed, the method further comprising the step of:

advancing the wire through the axial passage into the combustion products, thereby providing a spray of liquid metal particles.

7. The method of claim 4 further comprising the step of:

introducing into the central passage a powdered coating material to be sprayed, the powdered coating material being introduced through the axial obstruction.

8. A method of establishing a supersonic flame jet stream generated by a torch used for bonding material onto a surface, the method comprising the steps of:

creating a vortex of gaseous oxygen within and through an extended bore of the torch to a torch exit, the vortex of oxygen being constrained against a sidewall of the bore, the vortex possessing an eye positioned centrally through the extended bore along the central axis, the vortex having an oxygen velocity that increases as it approaches an eyewall region that surrounds the eye, and where there is minimal swirling action within the eye;

passing a gaseous fuel through at least one fuel passage into the vortex, the at least one fuel passage being substantially parallel to a central axis of the extended bore and being offset from the central axis by a sufficient distance as to introduce the fuel into a region of the vortex outside of the eye, in the vicinity of the location where the swirling action of the oxygen is greatest, to cause the fuel to penetrate into and mix rapidly with the swirling oxygen surrounding the eye within the bore;

limiting the length of the bore such that the oxygen vortex provides a sheath of unmixed oxygen along the sidewall of the bore extending to the torch exit; and igniting the mixed fuel and oxygen exiting from the extended bore to cause combustion of the mixing fuel and oxygen within the bore so as to generate the supersonic jet stream beyond the torch exit.

9. The method of claim 8 wherein the stream of combustion products is employed to coat a solid coating material onto a workpiece onto which the combustion products impinge, the method further comprising the step of:

introducing the solid coating material into the combustion products after they exit the bore at the torch exit.

10. The method of claim 9 wherein said coating material is formed as a wire.

* * * * *